US006159265A

United States Patent [19]

Kinoshita et al.

[11] Patent Number: 6,159,265

[45] Date of Patent: Dec. 12, 2000

[54] POWERED METAL INJECTION COMPACTING COMPOSITION

[75] Inventors: Hiromitsu Kinoshita; Tetsuo Shiraiwa, both of Osaka; Hidetaka Uraoka, Shiga; Nobuo Ochiai, Kyoto, all of Japan

[73] Assignees: Dai-Ichi Kogyo Seiyaku Co., Ltd., Kyoto; Dai-Ichi Ceramo Ltd., Shiga, both of Japan

[21] Appl. No.: 09/502,659

[22] Filed: Feb. 11, 2000

[30] Foreign Application Priority Data

Apr. 19, 1999 [JP] Japan ..... 11-110842

[51] Int. Cl.[7] ..... C22C 1/05; C08K 3/08; C08K 5/12; C08K 5/00; C08L 91/06

[52] U.S. Cl. ..... 75/230; 75/252; 75/255; 75/321; 524/275; 524/277; 524/297; 524/440; 524/487

[58] Field of Search ..... 524/141, 143, 524/275, 277, 292, 296, 297, 314, 474, 478, 479, 480, 481, 488, 489, 439, 440, 441; 75/230, 252, 255, 321

[56] References Cited

U.S. PATENT DOCUMENTS 5,421,853 6/1995 Chen et al. ..... 75/252
5,641,920 6/1997 Hens et al. ..... 75/255
5,678,165 10/1997 Wu ..... 75/252
6,051,184 4/2000 Kankewa ..... 75/252
6,068,813 5/2000 Semel ..... 75/255

FOREIGN PATENT DOCUMENTS 3-170602 7/1991 Japan .

*Primary Examiner*—Peter A. Szekely
*Attorney, Agent, or Firm*—Jordan and Hamburg

[57] ABSTRACT

The object is to provide a powdered metal injection compacting composition adapted to give compacts free from deformation, cracking or blistering without being compromised in compactability or debinder characteristic and without the aid of a special jig.

This composition comprises a metal powder and an organic binder comprising (A) a crystalline resin having a melting point of not less than 150° C., (B) an organic compound the weight loss on heating of which begins at a temperature below 150° C. and (C) a composite acrylic resin, the composite acrylic resin mentioned above being a resin obtainable by dispersing a solution comprising the following components (C1)~(C3) in an aqueous medium containing a dispersant and carrying out a suspension polymerization reaction:

(C1) an ethylene-vinyl acetate copolymer or an ethylene-ethyl acrylate copolymer, (C2) a (meth)acrylic ester monomer or a mixture of a (meth)acrylic ester monomer and a styrenic monomer, and (C3) a polymerization initiator.

4 Claims, No Drawings

POWERED METAL INJECTION COMPACTING COMPOSITION

TECHNICAL FIELD

This invention relates to a powdered metal injection compacting composition and more particularly to an injection compacting composition comprising a metal powder and an organic binder which is excellent in injection compactability and postcompacting binder removal characteristic conducive to a reduced deformation of compacts.

BACKGROUND OF THE INVENTION

Prior Art

Today, in the field of ceramics, a variety of products are being produced by the technology which comprises, in sequence, blending a starting ceramic powder with an organic binder to impart plasticity to the powder, injection-compacting the powder to obtain a green compact, removing the binder and sintering the compact. This process is characterized in that geometrically complicated parts which cannot be produced by press forming, for instance, can be manufactured commercially with good high-production reproducibility.

Meanwhile, in the field of sintered metal parts, it is by now a time-honored practice to manufacture sintered metal parts by the technology called powder metallurgy, that is the production technology which comprises adding a certain amount of an organic substance to a starting powder, shaping the powder by press forming, and sintering the compact. In recent years, however, for the commercial manufacture of geometrically complicated parts with good high-production reproducibility, attempts have been made to apply the above-mentioned injection compacting technology in use for ceramic products to the production of sintered metal parts.

However, the manufacture of sintered metal parts by the injection compacting technology has problems, for the following and other reasons.

(1) Whereas the average particle diameter of the starting powder used for ceramic products is as fine as 3 $\mu$m or less, metal powders are comparatively coarse.

(2) The starting powder for sintered metal parts has a high specific gravity in many instances as compared with the ceramic powder in general, such as alumina powder.

(3) Compared with general-purpose ceramic powders, e.g. oxide type ceramic powders such as alumina powder, powdered metals are low in wettability with binders.

For those reasons, the deformation on removal of the binder is larger than it is the case with ceramics and if an attempt is made to produce sintered metal parts under conditions comparable to those in use for the production of ceramic parts, poor injection compactability, deficiencies in strength of the green compact, deformation of the green compact on removal of the binder and other troubles are encountered so that it is difficult to manufacture sintered parts comparable to ceramic parts in quality. Moreover, as experienced frequently, it is even impossible to obtain green compacts which worth sintering and, for this reason, the use of a special jig has been found necessary in some cases.

OBJECT OF THE INVENTION

Having been developed in the above state of the art, this invention provides a powdered metal injection compacting composition with which a high-density sintered metal product having a complicated geometry can be produced on a commercial scale with good high-production reproducibility without the aid of any special jig.

SUMMARY OF THE INVENTION

The powdered metal injection compacting composition of this invention is a composition comprising a metal powder and an organic binder characterized in that said organic binder comprises (A) a crystalline resin having a melting point of not less than 150° C., (B) an organic compound the weight loss on heating of which begins at a temperature below 150° C., and (C) a composite acrylic resin, said (C) composite acrylic resin being a resin obtainable by dispersing a solution comprising the following components (C1)~(C3) in an aqueous medium containing a dispersant and carrying out a suspension polymerization reaction:

(C1) an ethylene-vinyl acetate copolymer or an ethylene-ethyl acrylate copolymer, (C2) a (meth)acrylic ester monomer or a mixture of a (meth)acrylic ester monomer and a styrenic monomer, and (C3) a polymerization initiator.

In accordance with this invention there can be provided a metal injection compacting composition with which compacts free from deformation, cracks and blisters can be produced without compromise in compactability and debinder (in this specification, "debinder " means a "removal of binder") characteristic and without requiring any special jig. The additional advantage of the injection compacting composition of this invention it that there is no limitation on the geometry of parts which can be manufactured.

DETAILED DESCRIPTION OF THE INVENTION

Powdered Metal

The metal powder for use in this invention is not particularly restricted insofar as it is a metal powder which is in routine use in combination with an organic binder for the production of green compacts for sintered metal parts. However, it is preferably a metal powder consisting of generally spherical particles having an average diameter of about 1–50 $\mu$m, more preferably about 1–12 $\mu$m. If the average particle diameter is less than 1 $\mu$m, the specific surface area of the powder is relatively increased so that even if an increased amount of the binder is used, it will be difficult, in many instances, to obtain a mixture showing a flow characteristic suited to injection compacting. Even if the powder is injection-compactable, the subsequent binder removal can hardly be carried out smoothly and, moreover, the compacts after removal of the binder(debinder) will be so fragile that they may not be easy to handle. On the other hand, a metal powder with a particle size larger than 50 $\mu$m tends to be insufficient in the strength of compacts, not only in the green state but also after removal of the binder.

The powdered metal which can be used includes but is not limited to powders of pure iron and iron alloys such as iron-nickel, iron-cobalt, stainless steel (JIS SUS 304L (average particle diameter 8.9 $\mu$m), JIS SUS 316L (average particle diameter 10.5 $\mu$m)), etc. and powders of tungsten, aluminum alloys, copper and copper alloys.

Crystalline Resin (A) with a Melting Point of not Less Than 150° C.

The crystalline resin (A) having a melting point of not less than 150° C. for use in this invention includes but is not limited to polypropylene, polyacetal and polyamide resins but is preferably polypropylene in view of the satisfactory flow characteristic it imparts to a mixture with powdered metal (Claim 2).

By formulating this crystalline resin (A) having a melting point of not less than 150° C., the deformation at temperatures up to 150° C. can be prevented.

Organic Compound (B) the Weight Loss on Heating of Which begins at a Temperature below 150° C.

The organic compound (B) which can be used in this invention is not particularly restricted, but waxes and plasticizers, among others, can be used with advantage because they impart a good fluidity to the mixture with powdered metal and are satisfactory in thermal decomposition characteristic (Claim 3).

The wax which can be used is whichever of a synthetic wax and a naturally-occurring wax, including parafm wax, microcrystalline wax, polyethylene wax, beeswax, carnauba wax, montan wax, polyalkylene glycol and so forth. The plasticizer includes dibutyl phthalate, dioctyl phthalate, phosphoric esters, and fatty acid esters, among others.

By formulating said organic compound (B) the weight loss on heating of which begins at a temperature below 150° C., it is made possible to reduce the binder content at a temperature over 150° C. and, hence, reduce the plasticity of the compact to prevent its deformation.

Composite Acrylic Resin (C)

The composite acrylic resin (C) for use in this invention is the resin obtainable by dispersing a solution comprising (C1) an ethylene-vinyl acetate copolymer or an ethylene-ethyl acrylate copolymer, (C2) a (meth)acrylic ester monomer or a mixture of a (meth)acrylic ester monomer and a styrenic monomer, and (C3) a polymerization initiator in an aqueous medium containing a dispersant and carrying out a suspension polymerization reaction.

This composite acrylic resin (C) imparts good compactability without causing deformation of compacts on removal of the binder or reducing the debinder rate.

Ethylene-vinyl Acetate Copolymer

The ethylene-vinyl acetate copolymer (hereinafter referred to sometimes as EVA) is not particularly restricted but may be any of the polymers which are generally termed "ethylene-vinyl acetate copolymer". Preferred, however, is a copolymer with an ethylene/vinyl acetate ratio, by weight, of 85/15~50/50, more preferably 80/20~60/40. If the ratio exceeds 85/15, the resulting EVA will be hardly soluble in said (meth)acrylic ester monomer or said (meth)acrylic ester monomer-styrenic monomer mixture. On the other hand, an EVA with said ratio of less than 50/50 will not be readily available and, moreover, when such an EVA is used, the strength of green compacts tends to be poor.

The melt index (MI) of EVA is preferably about 10~500 from viscosity points of view, particularly when it is used in the form of a solution, and more preferably about 20~400 from the standpoint of the flow characteristic during compacting and the strength of green compacts.

Ethylene-ethyl Acrylate Copolymer

The ethylene-ethyl acrylate copolymer (hereinafter referred to sometimes as EEA) is not particularly restricted but may be any of those polymers which are generally termed "ethylene-ethyl acrylate copolymer". However, a copolymer with an ethylene/ethyl acrylate ratio, by weight, of 85/15~50/50, more particularly 80/20~60/40, is preferred. If this ratio exceeds 85/15, the EEA will not be easily dissolved in said (meth)acrylic ester monomer or said (meth) acrylic ester monomer-styrenic monomer mixture. On the other hand, an EEA with said ratio of less than 50/50 will not be readily available and, in addition, when such an EEA is used, the strength of green compacts tend to be poor.

The melt index (MI) of EEA is preferably about 10~2,000 from viscosity points of view, particularly when it is used in the form of a solution and more preferably about 100~1,500 from the standpoint of the flow characteristic during compacting and the strength of green compacts.

The use of EVA for (C1) gives an organic binder insuring good compact fluidity and giving green compacts of high strength. The use of EEA gives an organic binder conducive to an improved binder removal characteristic.

(Meth)acrylic Ester Monomer

The (meth)acrylic ester monomer which can be used in the practice of this invention is not particularly restricted but, from the standpoints of compact fluidity, strength of green compacts, and binder removal characteristic, it is preferably an ester of (meth)acrylic acid with an alcohol containing 1~8 carbon atoms. Thus, the (meth)acrylic ester monomer includes n-$C_{1-8}$ alkyl (meth)acrylates, isopropyl (meth)acrylate, isobutyl (meth)acrylate, t-butyl (meth) acrylate, 2-ethylhexyl (meth)acrylate, 2-methoxyethyl (meth)acrylate, 2-ethoxyethyl (meth)acrylate, and so forth. Particularly preferred, among them, are n-$C_{1-4}$ alkyl (meth) acrylates, e.g. n-butyl (meth)acrylate, as well as isopropyl (meth)acrylate and isobutyl (meth)acrylate. These can be used each alone or in a combination of two or more species.

Styrenic Monomer

The styrenic monomer which can be used in this invention includes styrene, α-methylstyrene, p-methylstyrene and vinylstyrene, among others.

When a mixture of styrenic monomer and (meth)acrylic ester monomer is used, the styrenic monomer preferably accounts for not more than 80% (weight %; the same applies hereinafter) of the mixture. The higher the proportion of the styrenic monomer in the mixture is, the lower is the fluidity of the organic binder, so that compact tends to become difficult.

Polymerization Initiator

The kind of polymerization initiator which can be used in the practice of this invention is not particularly restricted. As preferred examples, however, oil-soluble initiators, e.g. organic peroxides such as benzoyl peroxide, lauroyl peroxide, t-butylperoxy-2-ethyl hexanoate, etc. and azo compounds such as azobisisobutyronitrile, azobisdimethylvaleronitrile, etc. can be mentioned. These initiators may be used each alone or in a combination of two or more species.

Dispersant

The dispersant which can be used in this invention includes water-soluble organic polymers such as polyvinyl alcohol, hydroxmethylcellulose, polyvinylpyrrolidone, etc. and sparingly water-soluble fine powders such as hydroxyapatite, magnesium pyrophosphate, etc. as used in combination with an anionic surfactant.

The Formulating Ratios etc. of Various Components in Composite Acrylic Resin (C)

In the preparation of composite acrylic resin (C), a chain transfer agent can be used in addition to said components. As specific examples, mercaptan compounds such as n-dodecyl mercaptan, t-octyl mercaptan, etc., α-methylstyrene and dimerized α-methylstyrene can be mentioned. Those compounds can be used each alone or in a combination of two or more species.

Regarding the relative amounts of components (C1) and (C2), the (C1)/(C2) ratio by weight is preferably about 5/95~80/20, more preferably about 20/80~70/30. If the ratio is less than 5/95, the mixture of metal powder and the resulting organic binder tends to be insufficient in fluidity so that a poor compact result is liable to occur. If the ratio exceeds 80/20, the blistering of the green compact in thermal removal of the binder will become prominent to sacrifice the strength of the compact and, in addition, removal of the binder and handling of the compacting will be made difficult.

The amount of the polymerization initiator is preferably 0.05~1.5 parts, more preferably 0.1~0.6 part, relative to 100 parts (parts by weight, the same applies hereinafter) of component (C2) in consideration of reaction rate and molecular weight control.

The proportion of the dispersant is preferably 0.1~1 part, more preferably 0.2~0.5 part, relative to 100 parts of water to be used.

The proportion of the solution comprising said components (C1)-(C3) inclusive of the chain transfer agent which is optionally used, relative to 100 parts of the aqueous medium containing said dispersant is preferably 30~120 parts, more preferably 50~100 parts, from suspension stability and productivity points of view.

The formulating amount of the chain transfer agent, if used, is preferably 0.01~1.0 part, more preferably 0.03~0.5 part, relative to 100 parts of component (C2) from the standpoint of molecular weight control.

The conditions of suspension polymerization are not particularly restricted; thus, this polymerization reaction can be carried out in the per se conventional manner. For example, the polymerization temperature can be selected with reference to the decomposition temperature of the polymerization initiator to be employed and is usually somewhere between 50° and 130° C.

In this manner, an organic binder comprising a uniform, fine dispersion of component (C2) in component (C1) can be obtained. This organic binder can be used with advantage in compacting metal powders to provide sintered parts.

The Formulating Ratios etc. of Components (A)~(C)

The respective formulating ratios of said component (A), component (B) and component (C) are preferably such that the combined amount of components (A) and (C) is close to the amount of component (B), namely [component (A)+component IC)]/component (B)=30~60/70~40 (weight %). In the case where the combined amount of component (A)+component (C) is less than 30 weight %, that is to say the amount of component (B) exceeds 70 weight %, and in the case where the combined amount of component (A)+component (C) is more than 60 weight %, that is to say the amount of component (B) is less than 40 weight %, the deformation on debinder tends to occur.

Furthermore, the ratio of component (A)/component (C) within the range of 40~85/60~15 (weight %) is preferred for preventing the deformation at temperatures up to 150° C. more effectively.

It is to be understood that when components (A)~(C) are used in such proportions that the debinder rate(the debinder rate defined as [(compact(g)—(debinder-compact(g)))/compact(g)]×100) at 150° C. will be 20% or more, a marked deformation-preventing effect is obtained (Claim 4). ("debinder-compact" means "compact after removal of the binder".) The ratio of the powdered metal to the organic binder in the injection compacting composition of this invention is preferably controlled with the range of (powdered metal/organic binder)=100/4~100/15, by weight. If this ratio is less than 100/4, the injection compacting composition will be deficient in fluidity so that it tends to become difficult to produce compacts of the desired shape. If the ratio of 100/15 is exceeded, the density of compacts will not reach the necessary level so that not only is sintering shrinkage increased to sacrifice dimensional accuracy but, because thermal debinder gives off a large amount of gas, the incidence of cracks, blisters and other defects in compacts tends to be increased.

EXAMPLES

The following examples illustrate this invention in further detail but are by no means limitative of the scope of the invention.

Example of Synthesis-1 [synthesis of composite acrylic resin (C)-(1)]

A 5-L reactor was charged with 600 g of n-butyl methacrylate (BMA) and 0.3 g of n-dodecyl mercaptan, and the temperature was increased to 75° C. under constant stirring. Then, 900 g of ethylene-vinyl acetate copolymer (EVA) [Ultrasene 722, Tosoh Corporation] and, as polymerization initiator, 2.4 g of benzoyl peroxide were added and dissolved. Incidentally, the MI value of said EVA was 400 g/10 min. and the ethylene-to-vinyl acetate ratio (by weight) of the same was 72/28.

To this system was added an aqueous dispersant solution separately prepared from 1840 ml of deionized water and 160 ml of 3% aqueous solution of polyvinyl alcohol (PVA), followed by stirring to give a suspension of the EVA-BMA solution. After nitrogen gas purging, the polymerization was carried out at 80° C. for 3 hours and at 100° C. for 2 hours, at the end of which time the reaction product was cooled, taken out, washed and dried.

The resulting polymer was a powder consisting of spherical particles ranging from 0.3 to 1 mm in diameter and its intrinsic viscosity [η] in toluene at 30° C. was 0.85.

Example of Synthesis-2 [synthesis of composite acrylic resin (C)-2]

A 5-L reactor was charged with 700 g of n-butyl methacrylate (BMA), 500 g of styrene and 0.35 g of n-dodecyl mercaptan. After dissolution, 300 g of ethylene-vinyl acetate copolymer (EVA) [Ultrasene 722, Tosoh Corporation] was added with stirring and dissolved by heating at 75° C. Then, 4.8 g of benzoyl peroxide and 0.25 g of t-butyl peroxybenzoate were added and dissolved.

To this system was added an aqueous dispersant solution separately prepared from 1840 ml of deionized water and 160 ml of 3% polyvinyl alcohol (PVA)/water and adjusted to 80° C., followed by stirring to give a suspension. After nitrogen gas purging, the reaction was carried out at 80° C. for 5 hours and at 100° C. for 2 hours to complete polymerization. The reaction product was cooled, washed with water and dried to give a white powder consisting of spherical particles ranging from 0.3 to 1.0 mm in diameter. The intrinsic viscosity [η] of this polymer powder in toluene at 30° C. was 0.70.

Example of Synthesis-3 [synthesis of composite acrylic resin (C)-3]

A 5-L reactor was charged with 600 g of n-butyl methacrylate (BMA) and 0.3 g of n-dodecyl mercaptan, and the temperature was increased to 75° C. under constant stirring. Then, 750 g of ethylene-ethyl acrylate copolymer (EEA) [NUC-6070, Nippon Unicar] and, as polymerization initiator, 3.0 g of benzoyl peroxide were added and dissolved. Incidentally, the MI value of the above EEA was 250 g/10 min. and the ethylene-to-ethyl acrylate ratio (by weight) of the same was 75/25.

To this system was added an aqueous dispersant solution separately prepared from 1840 ml of deionized water and 160 ml of 3% polyvinyl alcohol (PVA)/water, followed by stirring to suspend the EEA-BMA solution. After nitrogen gas purching, the reaction was carried out at 80° C. for 4 hours and at 100° C. for 2 hours to complete polymerization.

After cooling, the reaction product was taken out, washed and dried to give a powder consisting of spherical particles ranging from 0.3 to 1 mm in diameter. The intrinsic viscosity [η] of this polymer powder in toluene at 30° C. was 0.78.

Examples 1~10 and Comparative Examples 1~7

One-hundred (100) parts of powdered metal [JIS SUS 316L (average particle diameter 10.5 μm), Taiheiyo Metal] was formulated with 11 parts of an organic binder and the mixture was kneaded with a pressure kneader and injection-compacted to give a prismatic testpiece sized 4×5×54 (mm). The organic binder was one of the mixtures prepared by using the components and recipes shown in the following Table 1 through Table 4.

Each testpiece was set in position with one end extending out by 15 mm from the setter and removed binder in the atmospheric air by heating to 300° C. at the rate of 10° C./hour and the degree of deformation was evaluated by observing the extent of sagging.

At the point of 150° C. partway in the course of debinder, the testpiece was taken out and the current debinder rate was determined.

The results are also shown below in Table 1~Table 4.

TABLE 1

| | | Example | | | | |
|---|---|---|---|---|---|---|
| | Organic binder | 1 | 2 | 3 | 4 | 5 |
| (A) | Polypropylene (m.p. 150° C.) | | 35% | 30% | | |
| | Polypropylene (m.p. 160° C.) | 20% | | | 20% | 40% |
| (A') | Amorphous polyolefin (s.p. 135° C.; Ring and Ball Test) | | | | | |
| | Polyethylene (m.p. 112° C.) | | | | | |
| | Polystyrene (Vicat s.p. 95° C.) | | | | | |
| (B) | Paraffin wax (weight loss on heating begins at 98° C., m.p. 47° C.) | 35% | 30% | | 40% | |
| | Paraffin wax (weight loss on heating begins at 120° C., m.p. 53° C.) | | | 35% | | 35% |
| | Paraffin wax (weight loss on heating begins at 184° C., m.p. 69° C.) | | | | | |
| | Microcrystalline wax (weight loss on heating begins at 202° C., m.p. 83° C.) | | | | | |
| | Dibutyl phthalate (weight loss on heating begins at 82° C.) | 15% | 15% | 10% | 20% | 5% |
| (C) | Composite acrylic resin (prepared in Example of Synthesis-1) | | | | 20% | |
| | Composite acrylic resin (prepared in Example of Synthesis-2) | 30% | 20% | 25% | | |
| | Composite acrylic resin (prepared in Example of Synthesis-3) | | | | | 20% |
| Physical properties | Sag (mm) | 0.0 | 0.0 | 0.2 | 0.5 | 0.2 |
| | debinder rate (%) | 27.8 | 25.3 | 22.1 | 28.6 | 20.5 |

*: The temperature at which the weight loss on heating of (B) begins is the value obtained by Tg measurement with the CERAMO (10° C./hr).

TABLE 2

| | | Example | | | | |
|---|---|---|---|---|---|---|
| | Organic binder | 6 | 7 | 8 | 9 | 10 |
| (A) | Polypropylene (m.p. 150° C.) | 20% | 20% | | 35% | |
| | Polypropylene (m.p. 160° C.) | | | 20% | | 30% |
| (A') | Amorphous polyolefin (s.p. 135° C.; Ring and Ball Test) | | | | | |
| | Polyethylene (m.p. 112° C.) | | | | | |
| | Polystyrene (Vicat s.p. 95° C.) | | | | | |
| (B) | Paraffin wax (weight loss on heating begins at 98° C., m.p. 47° C.) | 40% | 60% | 30% | | 30% |
| | Paraffin wax (weight loss on heating begins at 120° C., m.p. 53° C.) | | | | 30% | |
| | Paraffin wax (weight loss on heating begins at 184° C., m.p. 69° C.) | | | | | |
| | Microcrystalline wax (weight loss on heating begins at 202° C., m.p. 83° C.) | | | | | |
| | Dibutyl phthalate (weight loss on heating begins at 82° C.) | | | 10% | 15% | 20% |
| (C) | Composite acrylic resin (prepared in Example of Synthesis-1) | 40% | | | 20% | |
| | Composite acrylic resin (prepared in Example of Synthesis-2) | | 20% | 40% | | 20% |
| | Composite acrylic resin (prepared in Example of Synthesis-3) | | | | | |
| Physical properties | Sag (mm) | 0.7 | 1.1 | 0.2 | 1.5 | 0.0 |
| | debinder rate (%) | 20.7 | 22.4 | 20.4 | 21.6 | 25.7 |

TABLE 3

| | | Comparative Example | | | |
|---|---|---|---|---|---|
| | Organic binder | 1 | 2 | 3 | 4 |
| (A) | Polypropylene (m.p. 150° C.) | | | | |
| | Polypropylene (m.p. 160° C.) | | | | |
| (A') | Amorphous polyolefin (s.p. 135° C.; Ring and Ball Test) | 15% | | | 20% |
| | Polyethylene (m.p. 112° C.) | | 35% | | |
| | Polystyrene (Vicat s.p. 95° C.) | | | 25% | 35% |
| (B) | Paraffin wax (weight loss on heating begins at 98° C., m.p. 47° C.) | | 30% | | |
| | Paraffin wax (weight loss on heating begins at 120° C., m.p. 53° C.) | | | | |
| | Paraffin wax (weight loss on heating begins at 184° C., m.p. 69° C.) | 35% | | 40% | |
| | Microcrystalline wax (weight loss on heating begins at 202° C., m.p. 83° C.) | | | | 40% |
| | Dibutyl phthalate (weight loss on heating begins at 82° C.) | 10% | 15% | 10% | 5% |
| (C) | Composite acrylic resin (prepared in Example of Synthesis-1) | | | 25% | |
| | Composite acrylic resin (prepared in Example of Synthesis-2) | 40% | | | |
| | Composite acrylic resin | | 20% | | |

TABLE 3-continued

| | Organic binder | Comparative Example 1 | 2 | 3 | 4 |
|---|---|---|---|---|---|
| | (prepared in Example of Synthesis-3) | | | | |
| Physical properties | Sag (mm) | 6.9 | 8.8 | 10.2 | 14.2 |
| | debinder rate (%) | 17.3 | 21.4 | 16.5 | 3.4 |

TABLE 4

| | Organic binder | Comparative Example 5 | 6 | 7 |
|---|---|---|---|---|
| (A) | Polypropylene (m.p. 150° C.) | | 25% | |
| | Polypropylene (m.p. 160° C.) | | | 40% |
| (A') | Amorphous polyolefin (s.p. 135° C.; Ring and Ball Test) | | | 10% |
| | Polyethylene (m.p. 112° C.) | 25% | | 15% |
| | Polystyrene (Vicat s.p. 95° C.) | 25% | 35% | |
| (B) | Paraffin wax (weight loss on heating begins at 98° C., m.p. 47° C.) | 20% | | 25% |
| | Paraffin wax (weight loss on heating begins at 120° C., m.p. 53° C.) | | | |
| | Paraffin wax (weight loss on heating begins at 184° C., m.p. 69° C.) | | 30% | |
| | Microcrystalline wax (weight loss on heating begins at 202° C., m.p. 83° C.) | 30% | | 10% |
| | Dibutyl phthalate (weight loss on heating begins at 82° C.) | | 10% | |
| (C) | Composite acrylic resin (prepared in Example of Synthesis-1) | | | |
| | Composite acrylic resin (prepared in Example of Synthesis-2) | | | |
| | Composite acrylic resin (prepared in Example of Synthesis-3) | | | |

TABLE 4-continued

| | Organic binder | Comparative Example 5 | 6 | 7 |
|---|---|---|---|---|
| Physical properties | Sag (mm) | 13.8 | Not compact able | Not compact able |
| | debinder rate (%) | 7.8 | | |

What is claimed is:

1. A powdered metal injection compacting composition comprising a metal powder and an organic binder, said organic binder comprising (A) a crystalline resin having a melting point of not less than 150° C., (B) an organic compound the weight loss on heating of which begins at a temperature below 150° C., and (C) a composite acrylic resin which is obtainable by dispersing a solution comprising the following components (C1)~(C3) in an aqueous medium containing a dispersant and carrying out a suspension polymerization reaction:

(C1) an ethylene-vinyl acetate copolymer or an ethylene-ethyl acrylate copolymer, (C2) a (meth)acrylic ester monomer or a mixture of a (meth)acrylic ester monomer and a styrenic monomer, and (C3) a polymerization initiator.

2. The composition defined in claim 1 wherein the crystalline resin (A) is polypropylene.

3. The composition defined in claim 1 or 2 wherein the organic compound (B) is a wax and/or a plasticizer.

4. The composition defined in any of claim 1 or 2 which gives a debinder rate defined as ×100 of not less than 20% at 150° C.

* * * * *